US008579499B2

(12) United States Patent
Moroni et al.

(10) Patent No.: US 8,579,499 B2
(45) Date of Patent: Nov. 12, 2013

(54) DEVICE FOR WINDING WATCHES, IN PARTICULAR MANUALLY-WOUND WATCHES

(75) Inventors: Alberto Moroni, Parabiago (IT); Mario Moroni, Parabiago (IT); Fabrizio Ceraolo, Lucerne (CH)

(73) Assignee: MCM Milano S.R.L., Parabiago (IT)

( * ) Notice: Subject to any disclaimer, the term of this patent is extended or adjusted under 35 U.S.C. 154(b) by 226 days.

(21) Appl. No.: 12/984,303

(22) Filed: Jan. 4, 2011

(65) Prior Publication Data

US 2011/0170380 A1 Jul. 14, 2011

(30) Foreign Application Priority Data

Jan. 13, 2010 (EP) ..... 10425003

(51) Int. Cl.
*G04B 5/00* (2006.01)

(52) U.S. Cl.
USPC ..... 368/209; 368/319; 81/7.5

(58) Field of Classification Search
USPC ..... 368/206–216; 81/7.5; 439/701
See application file for complete search history.

(56) References Cited

U.S. PATENT DOCUMENTS

| | | | | | |
|---|---|---|---|---|---|
| 2,060,268 | A * | 11/1936 | Vass | 185/43 |
| 2,588,042 | A * | 3/1952 | Poltrock | 81/7.5 |
| 2,617,248 | A * | 11/1952 | Brown | 368/144 |
| 2,638,024 | A * | 5/1953 | Gotter | 81/7.5 |
| 2,658,329 | A * | 11/1953 | Nelson | 368/207 |
| 2,917,955 | A * | 12/1959 | Leger | 81/7.5 |
| 3,620,007 | A * | 11/1971 | Kauffman | 368/206 |
| 4,057,958 | A * | 11/1977 | Wuntch | 368/207 |
| 5,988,871 | A * | 11/1999 | Bonnet | 368/206 |
| 6,254,270 | B1 * | 7/2001 | Agnoff | 368/206 |
| 6,439,761 | B1 * | 8/2002 | Agnoff | 368/206 |
| 7,270,474 | B2 * | 9/2007 | Agnoff | 368/206 |
| 2003/0076748 | A1 * | 4/2003 | Rustioni | 368/206 |

FOREIGN PATENT DOCUMENTS

| | | |
|---|---|---|
| CH | 676308 | 1/1991 |
| GB | 2427942 | 1/2007 |

OTHER PUBLICATIONS

European Search Report of priority application EP 10425003.0 dated Jan. 13, 2010.

* cited by examiner

*Primary Examiner* — Amy Cohen Johnson
*Assistant Examiner* — Matthew Powell
(74) *Attorney, Agent, or Firm* — Greer, Burns & Crain Ltd.

(57) ABSTRACT

A device for winding watches, particularly manually-wound watches, comprising a containment structure which accommodates a motor, transmission means and a motor controller. The transmission means transfer the rotation of the motor, provided with power supply means, to a coupling which can be associated with the crown of the watch to be wound. The rotation is controlled by the controller.
The device comprises a seat for stably accommodating the watch to be wound, the seat being defined on a surface of the containment structure.

11 Claims, 3 Drawing Sheets

DEVICE FOR WINDING WATCHES, IN PARTICULAR MANUALLY-WOUND WATCHES

This application claims the benefit of the European patent application No. 10425003.0 filed on Jan. 13, 2010, the entire disclosures of which are incorporated herein by way of reference.

The present invention relates to a device for winding mechanical watches, particularly manually-wound watches, both wrist-watches and pocket watches.

BACKGROUND OF THE INVENTION

The term "manually-wound watches" designates the type of watches in which winding occurs by turning of the element, known as crown, that usually protrudes laterally outside the watch case. The crown is connected to the winding mechanism inside the watch, which comprises a spring which, if wound sufficiently, releases the energy necessary to move the hands and thus to operate the watch.

In order to wind such mechanism that comprises the spring, it is necessary to turn the crown about its axis.

The crown can be turned manually by the user; however, in some situations, a winding controlled by an electronic device or a faster winding than is attainable manually by a user may be necessary.

Several devices for winding manually-wound watches are known in the background art.

It is known to use electric or electronic devices provided with a power source, a motor and a system designed to transfer to the watch crown the rotation applied by the motor. The element suitable to jointly connect the crown to the axis that turns it is known as "spindle" and is actuated in known devices by means of a spring.

U.S. Pat. No. 6,439,761 discloses, for example, an electronic winding device with biaxial adjustment means for arranging the watch crown correctly with respect to the spindle of the device. Moreover, such device comprises an interface for adjusting periods, intervals and speeds of the rotation applied to the crown. An electronic sensor interrupts the winding when it detects that the watch has been fully wound.

However, such device is complicated and difficult to use because it forces the operator to perform a number of movements and attempts before he achieves the coaxial alignment of the crown with the spindle. Moreover, it is necessary to adjust the device according to the watch to be wound, thus causing very long preparation times. In particular, this characteristic makes it inconvenient to use the device for the sole purpose of occasionally is winding the watch.

Moreover, the presence of the means for obtaining correct positioning of the watch increases considerably the volume and weight of the device.

Another known device for winding manually-wound watches is disclosed in U.S. Pat. No. 5,988,871, which comprises a mechanism for opening and closing the spindle on the watch crown which is provided with a button connected to a spring and to an extensible arm. The spindle is composed of two claws and is connected to an end of the extensible arm. By pressing the button the arm is extracted and the spindle is opened. Once the watch has been positioned, the button is released and the arm retracts in the original position by means of the spring, while the spindle closes on the crown. This device has a mechanical friction system, which is adjusted manually for avoiding excessive loading of the spring of the mechanical watch and thus avoiding breakage of the mechanism inside it.

This device suffers problems related to the positioning of the crown axis with respect to the mechanism of the device. In particular, the alignment of the spindle axis with respect to the watch crown axis is initially entirely accidental. Only a correct alignment of the two axes leads to a precise and efficient winding of the watch, and this is determined exclusively by the user's skill.

Moreover, since manually-wound watches of different brands have different bulks as well as a different number of turns and winding torque, a regulator is provided to allow the user to adapt the device to the watch that he intends to wind. However, this is inaccurate and even risky, because the inner mechanism of the watch is very delicate and it is necessary to apply the right torque and an appropriate speed to the rotation of the crown in order to avoid damage to the mechanism and to the spring comprised in the watch.

Moreover, in known devices the use of the spring-loaded spindle as an element for mating between the device and the crown makes it necessary is to move the watch along the crown pivot axis. This leads to a need for subsequent adjustments of the watch support in order to avoid inner wear and friction of the watch proper or unwanted transitions of the crown from the winding position to the date-change or time-change position.

Moreover, in order to use a spring-loaded spindle it is necessary that the crown axis and the spindle axis be coaxial; otherwise significant cyclic torques are generated which could damage the watch.

Moreover, the use of a spring-loaded spindle might damage the crown and the watch case in case of a partial or excessive insertion of the spindle.

Another drawback of known devices consists in that they have bulky external blocks arranged to the side of the face of the watch, in which all the elements suitable to compose the winding mechanism are assembled.

For example, in U.S. Pat. No. 5,988,871 the power supply battery is placed in the cushion around which the strap of the watch to be wound is wrapped, while the entire watch winding mechanism is still at the side of the face of the watch proper, and so are the associated volumes.

SUMMARY OF THE INVENTION

The aim of the present invention is to solve the above problems, by eliminating the drawbacks of the cited background art.

Within this aim, an object of the invention is to provide a device for winding manually-wound watches that has reduced weight and bulk.

Another object of the invention is to provide a device for winding watches that shortens the preparation time of the device before performing the winding.

Another object of the present invention is to provide a device for winding watches that is simple and easy to use.

An object of the present invention is to provide a device for winding watches that is capable of avoiding the risks of damaging the crown and the mechanisms inside the watch to be wound.

Another object of the present invention is to provide a device for winding watches that is capable of winding precisely, efficiently and without damage manually-wound watches, even of different bulks and types.

Another object of the invention is to provide a device for winding watches, particularly manually-wound watches, which is highly reliable, relatively easy to provide and has competitive costs.

This aim and these and other objects that will become better apparent hereinafter are achieved by a device for winding watches, particularly manually-wound watches, comprising a containment structure for accommodating a motor, transmission means and a motor controller, the transmission means being suitable to connect the motor to a coupling which can be associated with the crown of the watch to be wound, characterized in that the device comprises a seat for stably accommodating the watch to be wound, the seat being defined on a surface of the containment structure.

BRIEF DESCRIPTION OF THE DRAWINGS

Further characteristics and advantages of the invention will become better apparent from the description of a preferred but not exclusive embodiment of the device for winding watches according to the invention illustrated by way of non-limiting example in the accompanying drawings, wherein.

DESCRIPTION OF THE PREFERRED EMBODIMENTS

Figure 1:
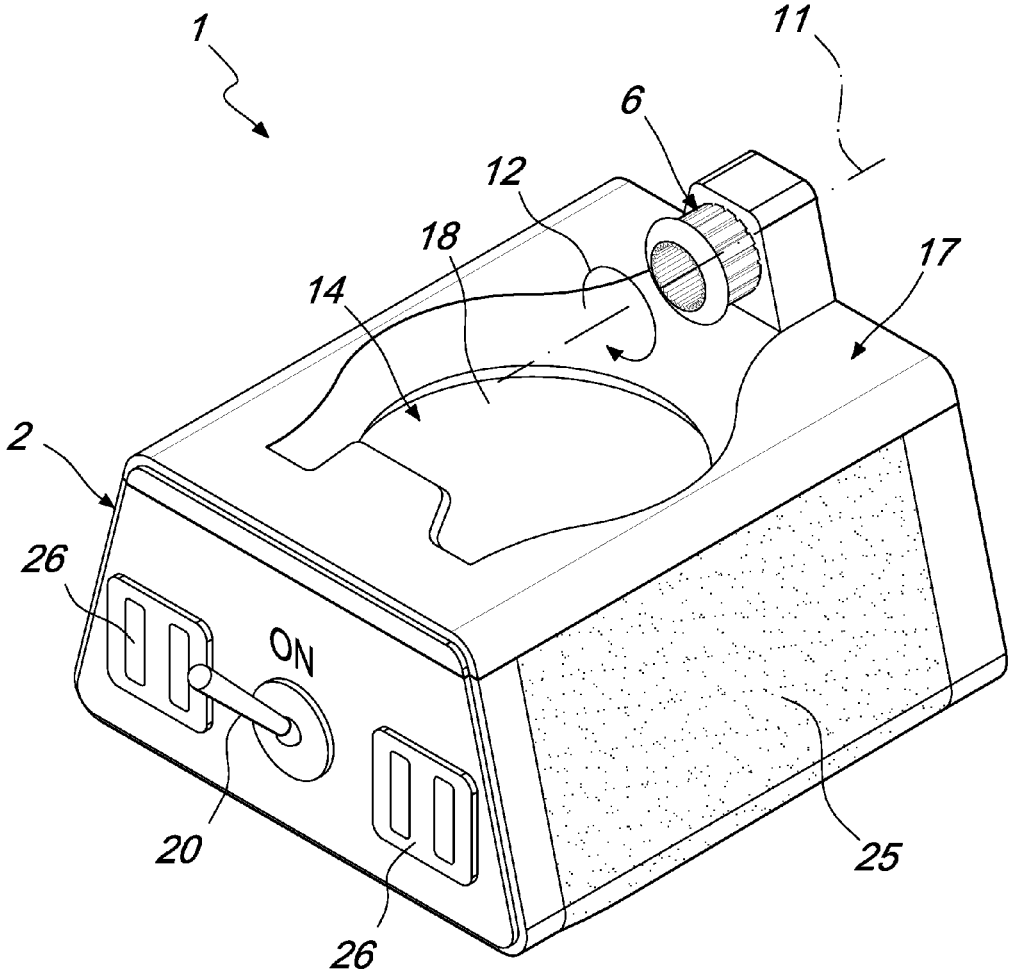
FIG. 1 is a perspective view of the device according to the invention.
Figure 2:
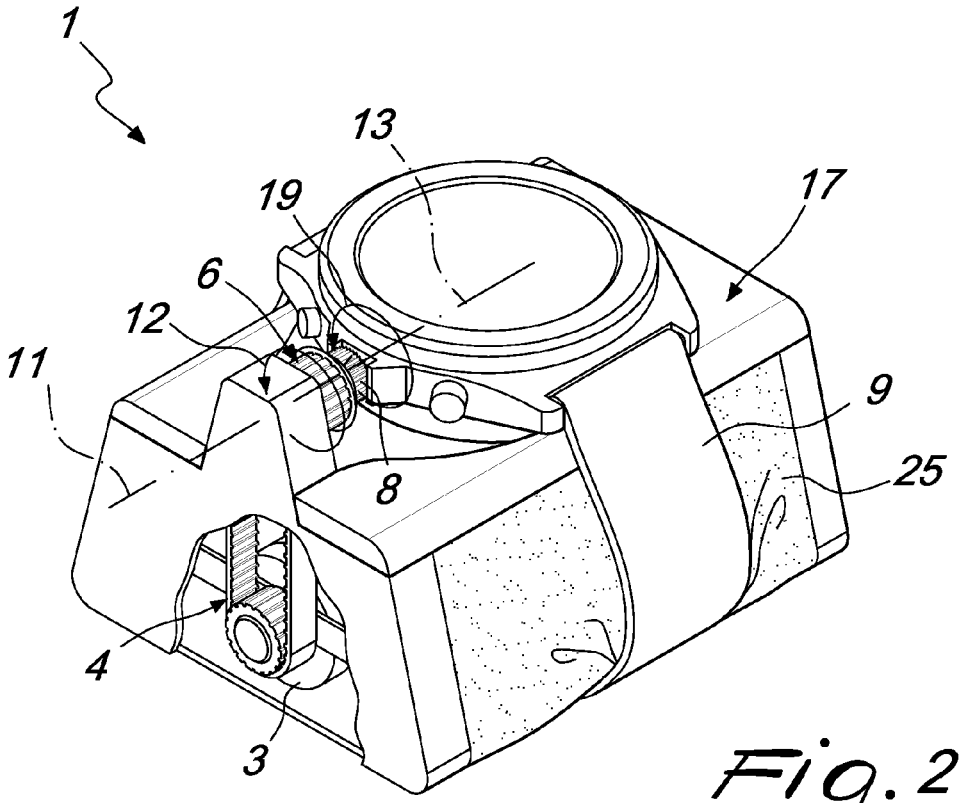
FIG. 2 is a perspective view of the device according to the invention, during the winding of a watch.
Figure 3:
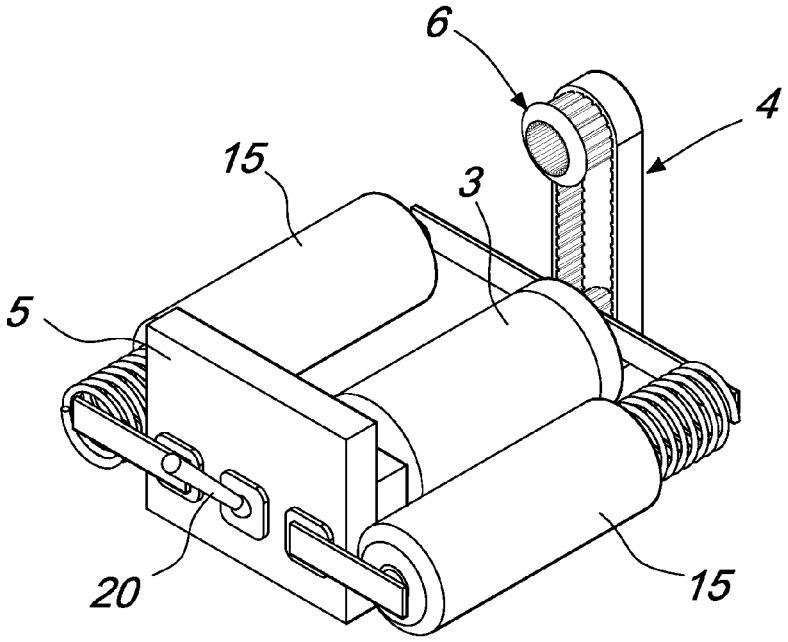
FIG. 3 is a perspective view of the device without the containment structure.

With reference to the figures, the device for winding watches, particularly manually-wound watches, according to the invention, generally designated by the reference numeral 1, comprises a containment structure 2, inside which an electric motor 3, transmission means 4 and an electronic controller 5 are accommodated.

The transmission means 4 connect the motor 3 to a coupling 6, which protrudes outside the containment structure 2.

The coupling 6 is the element of the device 1 that can be connected to, and that comes in contact with, the crown 8 of the watch 9 to be wound, by means of a shape coupling, or friction coupling, or toothed coupling or a similar coupling suitable to grip the external side wall of the crown and allow its rotation about its own axis.

The coupling 6 can be mated in a fixed or interchangeable manner with the transmission means 4. The second case makes it possible to select the most suitable coupling for each crown 8 of the watch 9 to be wound.

Advantageously, the coupling 6 can comprise an exact impression of at least a portion of the perimeter of the crown 8 of the watch 9 to be wound. Preferably, the impression of the coupling 6 fully reproduces the perimeter of the crown 8.

Conveniently, the controller 5 can be configured to actuate a clockwise or counter-clockwise pre-rotation suitable to promote the mating of the crown 8 with the coupling 6.

As an alternative, the coupling 6 can have a different geometry than the perimeter of the crown 8; however, it must always be able to interact with the crown 8 so as to rotate it. For example, a coupling 6 can be provided which mates with the crown 8 without involving the toothed part thereof, by clamping its protruding surfaces.

The coupling 6 can be made of elastomeric or ductile material so as to facilitate the interlocking of the crown 8 with the coupling 6, ensuring suitable mutual friction.

The power supplied by the motor 3 is transmitted by way of the transmission means 4 to the coupling 6 to produce a rotation 12 of the coupling 6 about its own axis 11.

The rotation 12 of the coupling 6 is controlled by the controller 5 by adjustment of the rotation rate, the torque and the rotation times of the motor 3.

The controller 5 is designed for the electronic control of the winding mechanism. More precisely, the controller is configured to measure the current absorbed by the motor 3 and the corresponding variations, and to adjust the current supplied by the motor 3, for example, by means of a pulse width modulator (PWM).

By connection of the coupling 6 to the crown 8 of the watch 9, the rotation 12 of the coupling 6 is transferred to the crown 8 of the watch to be wound, producing a rotary motion 19 of the crown 8 that is needed to wind the watch 9.

The transmission means 4 comprise all the elements interposed between the motor 3 and the coupling 6, i.e., all the elements that are used to transfer the rotation of the motor 3 to the coupling 6.

The transmission means 4 are preferably a belt connected between the shaft of the motor 3 and the coupling 6, but as an alternative they can include chains, pulleys or gears.

The motor 3 is associated with power supply means 15 such as, for example, batteries or solar cells. The power supply means 15 can be accommodated inside the containment structure 2 or can be placed outside the containment structure 2 and connected to the motor 3 contained in structure 2 by means of wiring and/or inductive coupling.

The device 1 comprises a seat 14 for stably accommodating the case of the watch 9 to be wound. The seat 14 is defined on a surface of the containment structure 2.

The seat 14 has a shape that is suitable to align the rotation axis 13 of the crown 8 of the watch to be wound, which is fixed in seat 14, with the rotation axis 11 of the coupling 6.

Therefore, the fact that the rotation axis 13 of the crown 8 is aligned with the rotation axis 11 of the coupling 6 thanks to a suitable shape of the seat 14 makes it possible to avoid the use of external centering means, thus reducing the overall bulk of the device 1.

The seat 14 can be defined and obtained directly on the upper surface of the containment structure 2 or it can be formed on a support 17 that can be associated with a surface of the containment structure 2.

The support 17 can be removable and interchangeable by the operator according to the shape and/or size of the case of the watch 9 and can advantageously be provided with guided translation means which allow the guided sliding and positioning of the support 17 on the surface of the containment structure 2. Such guided translation means can be, for example, springs, guides and/or spherical stop elements.

Preferably, the seat 14 comprises a recess 18 having the contour of the back of the watch 9 to be wound, as shown in FIG. 1.

The shape mating between the watch case and the recess 18 allows a stable and precise centering of the watch 9 inside the seat 14 of the device 1, which can be obtained simply by placing the watch in the seat of the device 1. This feature makes the device 1 particularly easy and quick to use, and enables any user to employ it.

If the seat 14 is formed on a movable support 17, the user first performs a simple movement of the support 17 with respect to the containment structure 2, then places the watch 9 in the seat 14 defined in the support 17 and finally performs a linear translation of the latter toward the coupling 6 until it stops.

The seat 14 and the coupling 6 can be made of elastomeric or ductile material in order to facilitate the interlocking of the components.

Advantageously, the device 1 for winding watches can comprise means for detecting the position of the seat 14 inside the device 1. For example, said detection means can be optical position sensors or sensors of another type, capable of measuring the distance of the seat 14 from a reference system provided on the device 1. In this manner it is possible to know the distance of the watch 9, accommodated in the seat 14, from the coupling 6 of the device 1.

Optionally, the seat 14 can comprise a memory medium which contains information related to the rotation that the device 1 applies to the crown 8 of the watch 9 by way of the coupling 6. The memory medium can be of the optical type (for example, a bar code or a series of symbols that can be optically identified), or a magnetic memory, or a transponder, or a contact-type memory (smart card or the like).

Said information is then read by the device 1 with the help of appropriate reading means.

If the memory medium associated with the seat 14 is a transponder, the reading means of the device 1 are suitable to send a query signal to the transponder, which is configured to transmit a reply signal to the reading means that contains the information related to the rotation to be applied to the watch model or models that can be fixed in the seat 14, in order to perform sufficient winding. This information can relate to the intensity, period and times of rotation necessary to wind the specific watch, accommodated in the seat 14, without damaging the internal mechanism thereof.

The device 1 for winding watches can comprise means for stopping the winding of the watch before the winding end lock is reached, which corresponds to the physical winding limit of the spring inside the watch 9.

In particular, the rotation applied by the coupling 6 to the crown 8 is stopped when a sufficient winding value is reached. More precisely, the controller 5 of the device 1 comprises a program for identifying said value, which is obtained by evaluating, by means of an appropriate algorithm, the maximum value of the second derivative of the current absorbed by the motor 3 during a full winding cycle.

Figure 4:
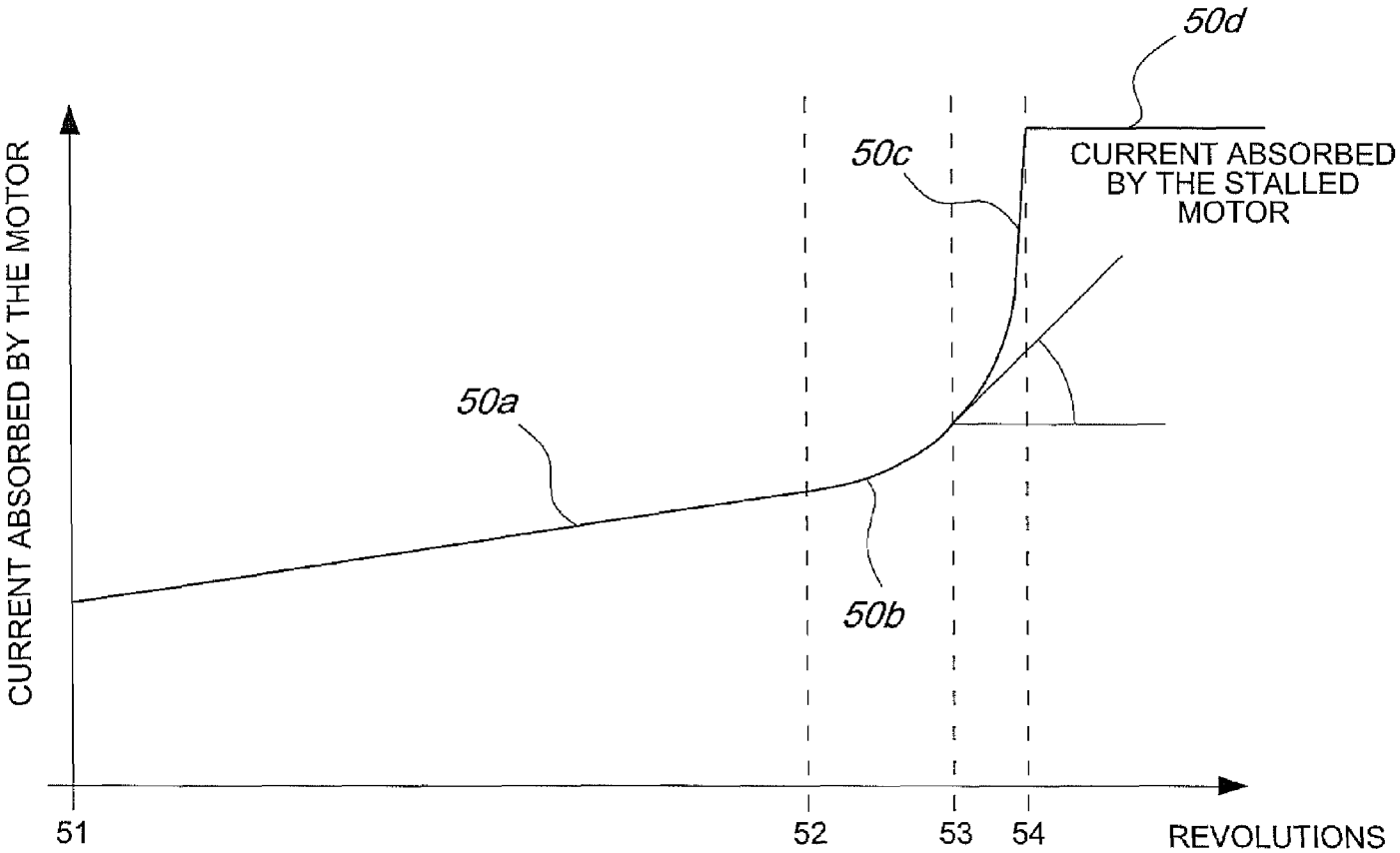
FIG. 4 is a chart plotting the torque and the current absorbed by the motor of the device according to the invention, during a complete winding cycle of the watch.

In detail, with reference to FIG. 4, it can be seen that in the first portion 50*a* comprised between the number of revolutions designated by the reference numerals 51 and 52, the absorbed current increases linearly; therefore the first derivative is constant while the second derivative is null.

In the second portion 50*b* comprised between the number of revolutions designated by the reference numerals 52 and 53, the absorbed current increases in a nonlinear manner, the first derivative and the second derivative being greater than zero.

In the third portion 50*c* comprised between the number of revolutions designated by the reference numerals 53 and 54, the absorbed current continues to increase in a non-linear manner, exhibiting however a change of concavity at the number of revolutions designated by 53; therefore, the first derivative continues to be greater than zero while the second derivative becomes smaller than zero.

Therefore, the point 53 is the maximum value of the second derivative of the absorbed current and is the value of sufficient winding at which the motor 3 is to be stopped, before reaching the winding end lock of the motor 3 in 54.

Indeed, when the number of revolutions limit value 54 is exceeded, one enters the region designated by the fourth portion 50*d* in which the motor 3, while being locked, continues to absorbing a constant quantity of current.

The containment structure 2 can be covered, in the portion that surrounds the seat 14, by a covering 25 made of soft and flexible material or by a padding; around this covering it is possible to wrap the strap of the watch 9 to be wound.

Moreover, the containment structure 2 can be provided with openings 26, which are designed, for example, to reach the battery compartment or to perform any maintenance or replacement of the internal elements, such as the controller 5 and the motor 3.

Moreover, a control switch 20 or an interface for controlling the device 1 can be present on an external wall of the containment structure 2 and can be connected to the controller 5.

The device 1 for winding mechanical watches can be accommodated inside a container that is suitable to contain it safely and configured to facilitate transport. Said containers are, for example, boxes or furnishing accessories, which can be placed in commercial areas for display purposes. The small size of the device 1 makes the face of the watch stand out while keeping the watch permanently wound.

In practice it has been found that the device according to the invention fully achieves the intended aim and objects, since it allows stable accommodation of the watch without increasing the bulk of the device.

In particular, the fact that the axis of the rotary motion of the crown is aligned in register with the rotation axis of the coupling thanks to a suitable shape of the seat makes it possible to obviate the problem of using external centering means, which increase the overall bulk of the device.

The fact that the seat follows the shape of the watch case makes it possible to obtain a stable and ideal centering of the watch, by means of a single movement of the operator.

Moreover, the fact that the support, on which the seat is defined, can be associated with the containment structure makes said support interchangeable and makes it possible to select the support, and therefore the seat, that are most suited for the specific watch to be wound.

Moreover, the fact that the coupling is made of flexible and ductile material makes it possible to avoid wear and damage to the watch crown.

Moreover, the presence of means for stopping the winding of the watch before the physical winding limit of the spring inside the watch is reached and the presence of the program for identifying the sufficient winding value of the watch make it possible to avoid excessive loads on the watch spring, which might cause forcing and damage thereof.

The device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

What is claimed is:

1. A device for winding watches comprising:

a containment structure accommodating a motor; a coupling which can be associated with a crown of a watch to be wound to transmit rotation thereof to the watch crown;

transmission means that connect the motor to said coupling to produce rotation of the coupling about a rotation axis thereof;

a motor controller that comprises a program for identifying by means of a suitable algorithm a sufficient winding value of a watch at which rotation applied to said crown is stopped, the sufficient winding value corresponding to a maximum value of the second derivative of the trend of the current absorbed by said motor; and a seat for stably accommodating the watch to be wound, said seat being defined on an upper surface of said containment structure and having a shape suitable to provide shape mating with the case of the watch to be wound and align a rotation axis of the crown of the watch to be wound with the rotation axis of said coupling upon placement of the watch in said seat, and wherein said seat comprises a memory medium that contains information related to a rotation to be applied to the coupling in order to perform a sufficient winding of a specific model of watch to be wound and in accordance with the sufficient winding value identified by said program, said containment structure being provided with means for reading said information.

2. The device according to claim 1, wherein said seat is defined on a support which can be associated with said surface of said containment structure, said support being provided with sliding means for its guided translation on said surface of said structure and for its at least partial removal from the containment structure.

3. The device according to claim 1, wherein said seat comprises a recess suitable to accommodate and lock the case of the watch to be wound, said recess having a surface contour such as to provide the shape mating between the watch case and the recess with ensuing stable and precise centering of the watch inside said seat upon placing of the watch in said seat.

4. The device according to claim 1, wherein said seat is made of elastomeric and/or ductile material.

5. The device according to claim 1, comprising means for detecting the position of said seat with respect to said containment structure.

6. The device according to claim 1, wherein power supply means of said motor are accommodated inside said containment structure.

7. The device according to claim 1, wherein power supply means of said motor are arranged outside said containment structure, said power supply means being connected to said motor by wiring and/or inductive coupling.

8. The device according to claim 1, wherein said coupling is made of elastomeric and/or ductile material.

9. The device according to claim 1, wherein said coupling is interchangeably coupled with said transmission means, the coupling coupled with said transmission means being selected so as to be a most suitable coupling for a specific crown of a watch to be wound.

10. A method for winding watches, particularly manually-wound watches, by means of a device according to claim 1.

11. A device for winding watches comprising:

a containment structure accommodating a motor; a coupling which can be associated with a crown of a watch to be wound to transmit rotation thereof to the watch crown;

transmission means that connect the motor to said coupling to produce rotation of the coupling about a rotation axis thereof;

a motor controller that comprises a program for identifying by means of a suitable algorithm a sufficient winding value of a watch at which rotation applied to said crown is stopped; and a seat for stably accommodating the watch to be wound, wherein said seat is defined on a support which can be associated with an upper surface of said containment structure and has a shape suitable to provide shape mating with the case of the watch to be wound and align a rotation axis of the crown of the watch to be wound with the rotation axis of said coupling upon placement of the watch in said seat, and wherein said seat comprises a memory medium that contains information related to a rotation to be applied to the coupling in order to perform a sufficient winding of a specific model of watch to be wound and in accordance with the sufficient winding value identified by said program, said containment structure being provided with means for reading said information.

* * * * *